United States Patent [19]

Hintzen et al.

[11] 4,034,689

[45] July 12, 1977

[54] DEVICE FOR MANUFACTURING BRAIDED OPENINGS IN CUTS OF ARTICLES OF CLOTHING

[75] Inventors: Peter Hintzen, Krickenbach; Erich Willenbacher, Karlsruhe, both of Germany

[73] Assignee: Pfaff Industriemaschinen GmbH, Germany

[21] Appl. No.: 713,448

[22] Filed: Aug. 11, 1976

[30] Foreign Application Priority Data

Aug. 14, 1975 Germany ..... 7525743[U]

[51] Int. Cl.[2] ..... D05B 3/10

[52] U.S. Cl. ..... 112/68; 112/70; 112/121.12

[58] Field of Search ..... 112/121.12, 121.15, 112/121.11, 121.29, 68, 65, 70

[56] References Cited

U.S. PATENT DOCUMENTS

| | | | |
|---|---|---|---|
| 2,529,072 | 11/1950 | Bradford et al. | 112/68 |
| 2,581,046 | 1/1952 | Rich | 112/68 |
| 3,170,423 | 2/1965 | Henebry | 112/121.12 |
| 3,277,851 | 10/1966 | Dobner et al. | 112/121.12 |
| 3,474,747 | 10/1969 | Noiles | 112/121.12 |
| 3,930,453 | 1/1976 | Hintzen et al. | 112/68 |

*Primary Examiner*—H. Hampton Hunter
*Attorney, Agent, or Firm*—McGlew and Tuttle

[57] ABSTRACT

A folding mechanism, for a braid strip, is supported on a table plate, in which there is installed a tow-needle sewing machine having a cutting knife working between the needles, with the folding mechanism being inclined downwardly toward the stitch forming area of the sewing machine. Folding of the braid strip is effected by a shape bar, having an inverted T-shape, adapted to be lowered into a folding groove, in a baseplate of the folding mechanism to fold the braid strip so that its borders extend upwardly. Clamping bars are displaceable parallel to the stem of the shape bar, on opposite sides thereof, to clamp and fold the braid strip around the shape bar. The shape bar is vertically displaceable on a support which is pivotal about an axis parallel to the arm shaft of the sewing machine, between an initial position in which it is aligned with the folding cavity or groove, and a transfer position, aligned with the direction of displacement of a work clamp to deliver the braid strip, and a flap, if one is provided, to the work clamp.

10 Claims, 12 Drawing Figures

DEVICE FOR MANUFACTURING BRAIDED OPENINGS IN CUTS OF ARTICLES OF CLOTHING

FIELD AND BACKGROUND OF THE INVENTION

This invention relates to a device for manufacturing braided openings in cuts of articles of clothing, comprising a folding mechanism, for the braid strip, mounted at a location spaced from the stitch forming area of a two-needle sewing machine equipped with a cutting knife working between the needles, with the folding of the braid strip being effected by means of an inverted T-bar which is adapted to be lowered into a folding cavity, and by means of folding slides which are mounted for moving oppositely thereto, so that the braid strip is folded about the T-bar, and further comprising a work clamp by which a cut of clothing and, if provided, a flap to be placed in contact with the folded braid strip, are received and fed to the switch forming area of the sewing machine.

In many of the devices for manufacturing braided openings, the cut, the braid strip and, if provided, a flap for the following sewing operation, can be placed in position and aligned only at the end of the current operation, which results in considerable losses of time. That is why an effort has been made to arrange the feeding, folding and sewing stations, as well as the work clamp, in a manner such as to permit an overlapped operation, i.e., to make it possible to perform the manipulation necessary for bringing the cut, the braid strip and the flap to be processed in the next operation into a standby position, during the sewing time of the current operation.

For this purpose, it has been proposed to dispose the cut feed station and the braid strip feed station at a distance from the sewing station corresponding to the length of a cut. The braid strip feed station is disposed above the cut feed station. In this arrangement, the braid strip can be delivered from the feed station into the sewing position and folded only after the fabric clamp, which is equipped with folding slides for the braid strip, is displaced, with the sewing operation finished, to the cut feed station and lowered onto the cut. The braid strip is transported from the feed station to the cut by means of a clamping mechanism which is displaceable in a plane inclined relative to the vertical and in which one border of the braid strip is clamped and released again as soon as, after the transportation, it is put in place on the top of the work clamp. For folding the braid strip, the strip is pushed, by one part of the two-part braid strip shaping bar provided in this case, into a folding cavity of the work clamp and pressed into contact with the cut, whereupon, the folding slides of the work clamp are moved toward each other to form the double return folds of the braid strip. It is only then that the displacement of the work clamp for performing the next sewing operation can be started.

In this device, for reaching the sewing station, the free space between the feed station and the sewing station must be traversed by the work clamp at a rapid rate. Then, for the sewing operation, the speed of displacement of the work clamp is reduced. It is clear that, for this purpose, a correspondingly designed drive and control equipment is necessary, and that the supporting structure of such an equipment requires an adequate space. In addition, with this device, it is practically impossible for the operator to watch the stitch forming area because the feed stations for the cut and the braid strip are relatively far from the sewing machine.

A device is also known for manufacturing braided pockets with a flap, comprising two work clamps which are disposed one after the other in the direction of displacement. The first work clamp forms a unit with a folding mechanism and is provided at a location which is spaced from the stitch forming area of the sewing machine. In this first work clamp, during the current time for processing one of the workpieces, the braid strip is folded to the shape of an inverted T, the flap is placed into contact with the braid strip by means of a particular flap feed mechanism, and the cut of an article of clothing is brought into an aligned standby position. For receiving the work parts thus assembled in the standby position, the second work clamp is adapted to be moved into the first one. For receiving the assembled work parts, the second work clamp is displaced in a direction opposite to the direction of displacement necessary for performing the sewing operation, beyond the distance of displacement necessary for the sewing, to a location in front of the needles. With this arrangement, the stitch forming area is almost completely screened so that observation of the sewing operation is hardly possible. The actual transfer of the assembled work is effected so that the second work clamp is lowered onto the work which is received in the first work clamp in a standby position whereupon, as usual in the transfer of parts, toothed downholders, provided on the second work clamp, have their teeth projected through tooth spaces or gaps of toothed braid strip downholders which are provided on the first work clamp and which, subsequently, along with the clamping plates of the first work clamp, are moved laterally away so as to enable the second work clamp to displace the assembled work toward the stitch forming area.

SUMMARY OF THE INVENTION

The present invention is directed to an improvement of the design and arrangement of a device forming part of a unit for manufacturing braided openings and making it possible to prepare the component parts of the next workpiece, and bring them into a standby position in accordance with the requirements of processing, during the current time for processing the preceding workpiece, in order to avoid the mentioned drawbacks.

In accordance with the invention, a device is provided in which the folding mechanism is mounted, laterally of the stitch forming area and above the location where the cuts are fed in, so as to extend in a plane which is inclined relative to the table plate of the sewing machine, and the shape bar is mounted for vertical displacement on a support and for pivoting, along with the support, about an axis which is parallel to the longitudinal axis of the arm shat of the sewing machine, from an initial position, which is above a recess forming the folding cavity of the baseplate of the folding mechanism, into a transfer position, which is aligned, in front of the stitch forming area, with the direction of displacement of the work clamp, in order to effect the delivery of the braid strip and the flap to the work clamp, and clamping bars for the braid strip and the flap are provided which are mounted at either side of the vertical web of the shape bar and are displaceable in parallel thereto.

This arrangement results in a space-saving design making it possible to perform all preparatory work necessary for the next workpiece during the current processing time for the preceding workpiece and, to a large extent, to observe the stitch forming area.

In order to permit an adjustment to different thicknesses of the material, the folding slides are hinged to the baseplate at their edges opposite to their folding edges and are resiliently biased toward the plate.

A particularly simple arrangement for feeding the flap is obtained by providing a dog sheet which is mounted for displacement on the support and cooperates with a flap feed plate which is secured to one of the folding slides and made in one piece but resiliently flexible along a hinge-like bend.

In order to avoid the necessity of providing a separate spreader for the bent-up borders of the braid strip, the vertical web of the shape bar is, advantageously, extended to form a parting blade for the braid strip borders, extending to a location closely adjacent the cutting knife.

The shape bar can be brought very close to the stitch forming area in a simple manner, and without any collision with the parts of the sewing mechanism, by providing that it is displaceable in a plane which is inclined relative to the path of needle motion and in the direction of displacement of the work clamp and that it is guided in the support in a manner secured against rotation.

The possibility of controlling the individual units of the device as a function of the length of the flap and through a photoelectric cell is obtained by providing a reflection sheet on the work clamp, which can be introduced between the flap and the cut.

An object of the present invention is to provide an improved device for manufacturing braided openings in cuts of articles of clothing.

Another object of the invention is to provide such a device with which it is possible to prepare the component parts of the next workpiece, and bring them into a standby position in accordance with the requirements of processing, during the time a preceding workpiece is being processed.

A further object is to provide such a device which is space-saving and makes it possible to perform all preparatory work, necessary for the next workpiece, during the processing time for a preceding workpiece and, to a large extent, to observe the stitch forming area.

For an understanding of the principles of the invention, reference is made to the following description of a typical embodiment thereof as illustrated in the accompanying drawings.

DESCRIPTION OF THE PREFERRED EMBODIMENT

Figures 1, 3:
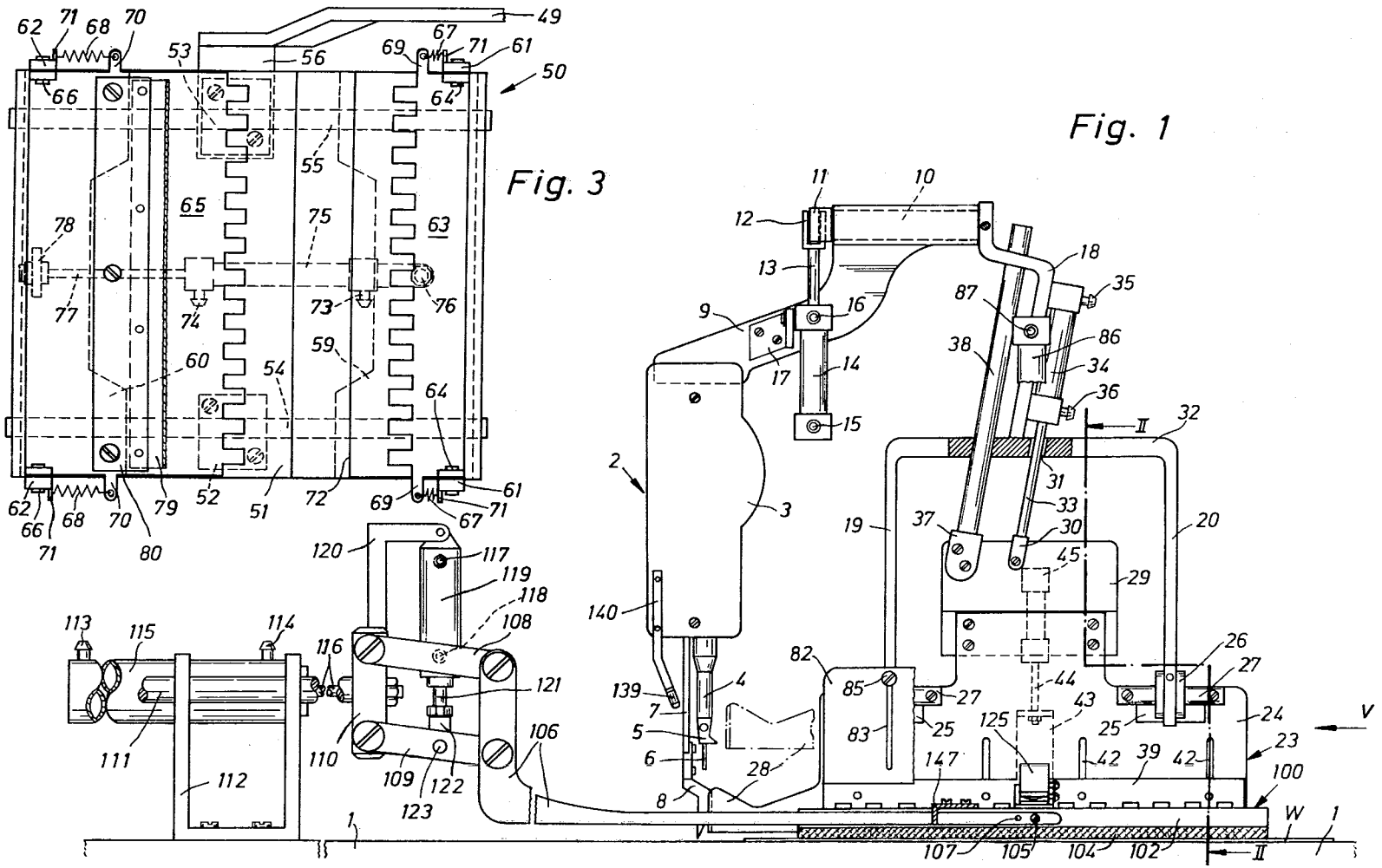
FIG. 1 is a lateral elevational view of the work clamp, the shape bar and the support for the bar, which is mounted on the housing of a sewing machine indicated by a front view of the head part thereof, the assembly being in the transfer position adjacent the stitch forming area.
FIG. 3 is a top plan view of the folding mechanism.
Figure 4:
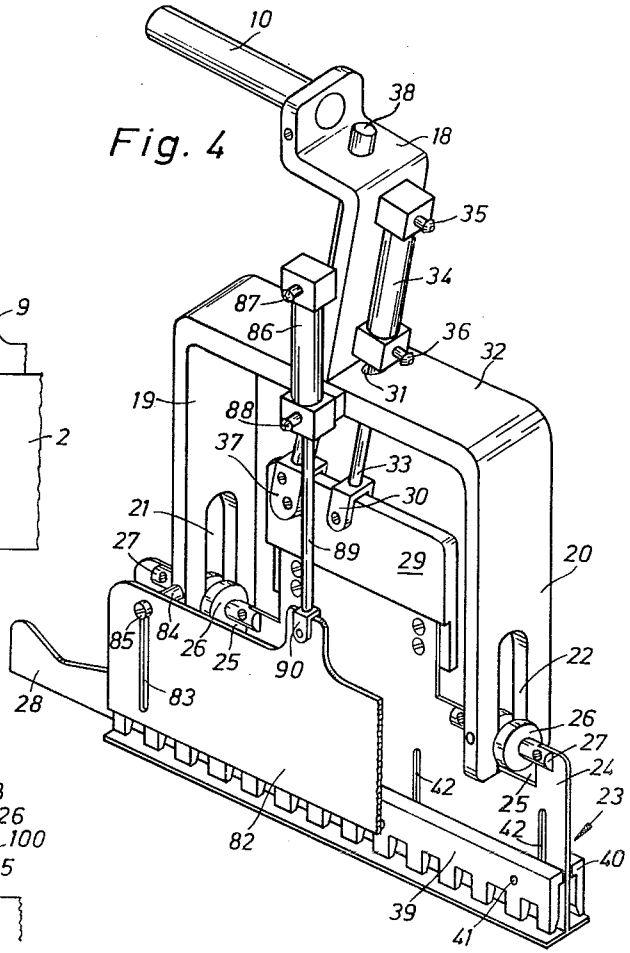
FIG. 4 is a perspective view of the shape bar, the support thereof, the clamping bars for the braid strip and the feed mechanism for the flap.

In the table plate 1 of a machine frame, a well-known two-needle sewing machine 2 without feed tools is installed. In the head part 3 of sewing machine 2, a needle bar 4 is mounted for vertical reciprocating motion, to which a needle guard 5 is secured, carrying two needles 6 in spaced apart relationship. Needles 6 cooperate, in a well-known manner, with respective hooks (not shown) for forming two mutually independent seams. A knife bar 7, which is also mounted for vertical reciprocating motion on head part 3, is adapted to be coupled, by means of a coupling mechanism (not shown), to the usual, constantly driven, knife drive lever of sewing machine 2. A cutting knife 8, working between needles 6, is secured to knife bar 7 and intended for cutting the passage slit in a braid strip P and a cut of clothing W. During operation, cutting knife 8 plunges into a guide slot of the throat plate of sewing machine 2.

Sewing machine 2 is also equipped with a device for cutting the threads and is driven by an electromotor. By means of a needle positioning mechanism, the sewing machine can be stopped in a selected position. The sewing operation is started and stopped and the other working operations are controlled by a well-known control system using pneumatic solenoid valves.

To the housing of sewing machine 2, a supporting arm 9 is secured. At the free end of arm 9, a shaft 10 is mounted for rotation. For pivoting shaft 10, a lever 11 is provided which is secured to one end of shaft 10 and pinned, by its other end, to a fork 12 which is secured to the piston rod 13 of an air cylinder 14. Air cylinder 14 is provided with connections 15 and 16 and pivotally mounted on an angle 17 which is secured to supporting arm 9. At the other end of shaft 10, a support 18 is secured, comprising two spaced apart legs 19, 20. The free ends of legs 19, 20 are forked to form downwardly open guide slots 21, 22.

Support 18 serves the purpose of receiving a shape bar 23 having the shape of an inverted T about which braid strip P is to be folded. In the vertical web 24 of shape bar 23, two recesses 25 are provided for receiving respective flanged rollers 26 mounted for rotation and axial displacement on respective pivot pins 27. Pivot pins 27 are slotted at both their ends and secured to web 24 at both sides of the respective recess 25. Flanged rollers 26 are guided in guide slots 21, 22 for vertical displacement.

Vertical web 24 of shape bar 23 is extended to form a parting blade 28 for the bent-up borders of braid strip P. In the transfer position of shape bar 23, shown in FIG. 1 in solid lines, blade 28 extends closely up to cutting knife 8 which works between the bent-up borders of braid strip P. The upper edge of shape bar 23 is secured to a retaining plate 29. Retaining plate 29 is pivotally connected to a fork 30 which is secured to the piston rod 33 of an air cylinder 34 provided on support 18 and having connections 35 and 36. Piston rod 33 extends through a bore 31 in the cross-web 32 of support 18. A fork 37 of a guide rod 38 is secured astride the border of retaining plate 29. Guide rod 38 is slidably guided in support 18, in a plane which is inclined relative to the path of motion of the needle bar. Due to this arrangement, shape bar 23 is mounted on support 18 so as to be movable vertically and, at the same time, in the direction of displacement of the work.

At each side of vertical web 24 of shape bar 23, a respective clamping bar 39, 40 is provided, having a toothed folding edge. Clamping bars 39, 40 are connected to each other by rivets 41 which are passed through oblong slots 42 in web 24, and are intended for clamping the folded braid strip P to shape bar 23. Clamping bar 40 is rigidly connected to an angle plate 43, FIG. 1 and 2, which is secured to the piston rod 44 of an air cylinder 45. Air cylinder 45 is provided with connections 46 and 47 and its other end is secured to retaining plate 29.

Figure 2:
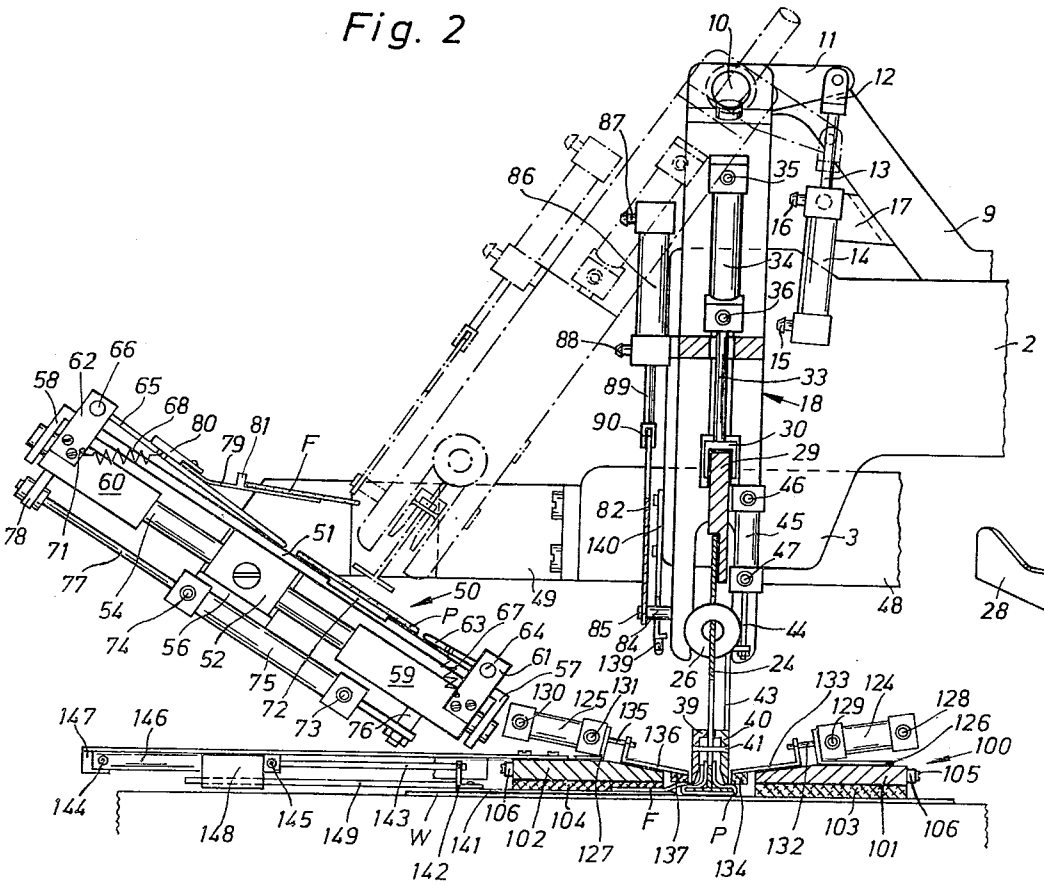
FIG. 2 is a sectional view of the device taken along the line II—II of FIG. 1, i.e., in a direction as viewed by the operator.
Figure 5:
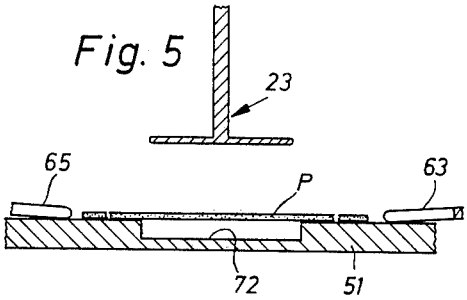
FIGS. 5 and 12 are enlarged illustrations of the individual phases in the treating of the component parts of the work.

To a housing 48, FIG. 2, which is mounted on table plate 1 of the machine frame and in which the electrical control elements of the device are accommodated, a supporting angle 49 is secured carrying the folding mechanism 50 for braid strip P which serves also for the purpose of feeding a flap F.

Two bearings block 52, 53 are screwed to the underside of a baseplate 51 of folding mechanism 50, as seen in FIG. 3. In each of bearing blocks 52, 53, a respective guide rod 54, 55 is fixed. In order to support and secure folding mechanism 50, supporting angle 49 is bent, at its front end 56, (FIG. 2), in a manner such that it engages bearing block 53 from below, and baseplate 51 is positioned, laterally spaced from the stitch forming area and above table plate 1, in a plane which is inclined relative to the horizontal plane in a manner such that cut W can be placed on table plate 1, in front of the stitch forming area, without any obstacles and aligned to luminous markings.

At two of its sides, baseplate 51 is angled downwardly to form bearing flanges 57, 38, (FIG. 2), for the ends of guide rods 54, 55. At each side of bearing blocks 52, 53, respective slide blocks 59, 60 are slidably guided on guide rods 54, 55, between bearing flanges 57, 58 and bearing blocks 52, 53.

A lug 61 is secured to each of the opposite sides of slide block 59 and, in a similar manner, lugs 62 are secured to opposite sides of slide block 60. A folding slide 63 having a toothed folding edge is mounted on lugs 61 for pivoting about an axis defined by pins 64, and, analogously, a folding slide 65 having a toothed folding edge is mounted on lugs 62 for pivoting about pins 66. Folding slides 63, 65 are resiliently biased toward baseplate 51 by means of two tension springs 67, 68 and, therefore, if materials having different thicknesses are processed, adapt to the respective thickness. The respective ends of tension springs 67, 68 are attached to eyes 69, 70 provided on folding slides 63, 65 and to pins 71 which are secured to lugs 61, 62.

For simultaneously displacing the two folding slides 63, 65, in opposite directions, toward a recess 72, which is machined in baseplate 51 and serves as a folding cavity for braid strip P, an air cylinder 75 having connections 73, 74 is provided at the underside of the following mechanism 50, and is pivoted, by one of its end, to a stay bolt 76 of slide block 59 and secured, by its piston rod 77, to a lug 78 of slide block 60.

For feeding a flap F in correct position, folding slide 65 carries a flap sheet 79 which is bent at an obtuse angle and secured, for example, riveted, to a holding strip 80 which is screwed to folding slide 65. Flap sheet 79 is provided with a stop rib 81 for flap F and is made in one piece. However, it is resiliently flexible in the area of its bending line. Flap sheet 79 cooperates with a dog sheet 82 which is provided on support 18, and is formed with two oblong slots 83, and sheet 82 is mounted for displacement on support 18, by means of two collar screws 85 which are passed through slots 83, and with interposed spacer sleeves 84. Dog sheet 82 is actuated by means of an air cylinder 86 which is mounted on support 18 and provided with connections 87, 88. The piston rod 89 of air cylinder 86 is connected, through a fork 90, to dog sheet 82.

In order to clamp component parts F, P and W of the work together, and to displace them through the stitch forming area, a work clamp 100 is used, comprising two clamping plates 101, 102 which are covered, on their underside, with an elastic lining 103, 104. The two clamping plates 101, 102 are disposed in spaced relationship so that a clear space, extending in the direction of displacement, is left therebetween for shape bar 23 with braid strip P, and they are mounted for limited oscillation, on respective supporting arms 106 by means of trunnion screws 105. The longitudinal axes of trunnion screws 105 coincide with an axis running through the center of gravity of work clamp 100. The oscillatory motion of clamping plate 101, 102 is limited by a pin 107, FIG. 1, which is secured to supporting arms 106 at a location laterally spaced from the respective trunnion screw 105 and projects into a slightly larger bore provided in each clamping plate 101, 102. At their ends, supporting arms 106 are angled upwardly and hinged, by means of two pairs of parallel links 108, 109, to a supporting plate 110 which is secured to two guide rods 111. Guide rods 111 can be displaced in the direction of displacement of work clamp 100 and, for this purpose, are guided in a bearing bracket 112 which is mounted on table plate 1.

To displace work clamp 100 this connected to supporting plate 110 through a parallelogram, a well-known hydropneumatic advance unit 115 is mounted on bearing bracket 112, which is provided with two connections 113, 114, and includes a piston rod 116 which is secured to supporting plate 110.

The elevating and lowering of work clamp 100 is effected by an air cylinder 119 which is provided with two connections 117, 118 and is hinged, by one of its ends, to an angle 120 which is welded to supporting plate 110. Piston rod 121 of air cylinder 119 carries a fork 122 which is pivoted, by means of its transversely bored end, to a rod 123 connecting the lower pair of links 109.

For clamping the braid strip and the flap in position during their displacement with work clamp 100, air cylinders 124, 125 (FIG. 2), are provided on clamping plates 101, 102, and are secured to clamping plates 101, 102. Air cylinders 124, 125 are provided with connections 128, 129 and 130, 131, respectively. Piston rod 132 of air cylinder 124 is secured to a clamping strip 133 which is provided, on its underside, with an elastic lining 134, and piston rod 135 of air cylinder 125 is secured to a clamping strip 136 carrying an elastic lining 137. Clamping strip 136 is provided with an oblong slot 138, FIGS. 10 to 12, for the passage of a light beam of a reflection light barrier 139 comprising a source of light and a photoconductive cell. Reflection light barrier 139 is mounted on a support 140 which is secured to head part 3 of sewing machine 2 and constitutes, along with a signal amplifier (not shown), a control system, controlled by flap F, for the operation of the sewing machine with the different equipment thereof, and of advance unit 115.

To effect the control of the sewing machine as a function of the length of flap F, a reflecting sheet 141 is provided, and can be introduced between cut W and flap F. Sheet 141 is secured to an angle bar 142 which, in turn, is secured to the piston rod 143 of an air cylinder 146 having connections 144 and 145. Air cylinder 146 is mounted on an angle bar 147 which is secured to clamping plate 102 and supports a guide member 148 which is provided with plain bores for two spaced apart guide rods 149 which are secured to angle bar 142.

Let it be assumed that the parts of the device shown in solid lines in FIG. 2 are in a position right before the start of the sewing operation, with sewing machine 2 stopped, and the needles in lifted position, and further, that support 18, along with shape bar 23 and a braid strip P and a flap F which are clamped to shape bar 23 by means of clamping bars 39, 40, are in the transfer position in front of the stitch forming area, that work clamp 100 is lowered onto a cut W which is placed on table plate 1 and clamping strips 133, 136 are lowered into contact with braid strip P and flap F, and that reflecting sheet 141 is in its operative position between flap F and cut W. Starting from this assumption, the device, which is controlled by means of a multipoint switch (not shown) and of reflection light barrier 139 as well as by a control program, operates as follows:

By supplying compressed air through connection 47, see FIG. 2, of air cylinder 45, clamping bars 39, 40 are moved upwardly, whereupon, following the supply of pressure fluid through connection 114 into the hydropneumatic advance unit, component parts F, P and W of the work are displaced by work clamp 100 in the direction of arrow V, FIG. 1. As soon as the light beam of reflection light barrier 139, which is directed through oblong slot 138 of clamping strip 136 against the path of motion of flap F, is no longer reflected by reflecting sheet 141, thus, as flap F arrives into the range of the light beam, an electronic counter is activated and a predetermined control program is started effecting the delivery of the necessary switching pulses for the control of the sewing machine and the individual units of the device.

First, work clamp 100 with the component parts F, P and W of the work is displaced in the direction of arrow V until the location provided for the start of the seam comes into a position which is beyond needles 6 by a distance necessary for securing the seams. The displacement is stopped by an interruption of the pressure-fluid supply to connection 114 of advance unit 115. Then, sewing machine 2 is started and, at the same time, pressure fluid is supplied to advance unit 115 through connection 113 so that work clamp 100 displaces component parts F, P and W in a direction which is opposite to the advance direction (arrow V), for securing the seams. Upon covering the length of the seam securing, the supply of pressure fluid to connection 113 is interrupted and advance unit 115 is supplied with pressure fluid again through connection 114. Thereby, work clamp 100 with component parts F, P and W is displaced in the advance direction (arrow V), perferably, intermittently in the rhythm of the stitch formation, while forming two parallel seams. At a location predetermined for this purpose, cutting knife 8 is put in operation through a coupling mechanism (not shown) in order to cut the slit of the braided opening to be made in cut W and the central zone of braid strip P.

During the advance of the component parts of the work toward the stitch forming area, the bent-up borders of braid strip P are held separated by parting blade 28 which extends closely up to cutting knife 8 so that knife 8 securely engages between the two bent-up borders of braid strip P.

Thereupon, the following operations are effected by the control program:

Cutting knife 8 is stopped, and the displacement of the work clamp in the direction of arrow V is interrupted by interrupting the pressure fluid supply to connection 114 of advance unit 115. Further, as soon as the trailing edge of flap F has passed the light beam emitted by reflection light barrier 139 so that the light beam is reflected by reflecting sheet 141, the displacement is reversed, by supplying pressure fluid to advance unit 115 through connection 113, for securing the seams upon reaching the ends thereof. The sewing machine is stopped, at the end of the seam securing, in a definite position of the needle bar, the threads are cut off and work clamp 100 is lifted from the then removable work by supplying compressed air through connection 118 of air cylinder 119. Clamping strips 133 and 136 are retracted by interrupting the compressed air supply to connection 128 of air cylinder 124 and to connection 130 of air cylinder 125 and supplying compressed air through connection 129 of air cylinder 124 and through connection 131 of air cylinder 125. Shape bar 23 is moved upwardly by interrupting the compressed air supply to connection 35 of air cylinder 34 and supplying compressed air through connection 36 thereof. Further, reflecting sheet 141 is retracted by interrupting the compressed air supply to connection 144 of air cylinder 146 and supplying compressed air to connection 145 thereof, and support 18, with shape bar 23, may be determined by adjustable stops or limit switches or by a combination of such means.

In the course of the just-mentioned operations, it is possible for the operator to feed a new braid strip P, through recess 72 of baseplate 51 of folding mechanism 50, serving as a folding cavity, and a new flap F, by placing it on flap feed sheet 79. A new cut W can be brought into a standby position on table plate 1 and aligned, for example, to luminous markings, as soon as shape bar 23 is lifted from table plate 1.

Figure 6:
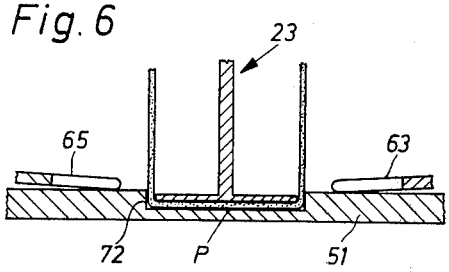
Figure 7:
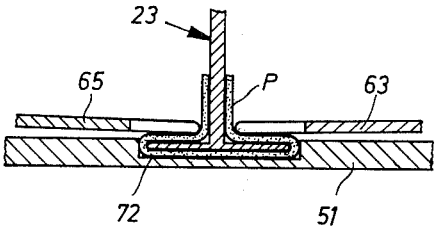

During the alignment of cut W, compressed air is supplied through connection 35 to air cylinder 34, which is effected by means of a starting pulse of the multipoint switch which, preferably, is a foot-operated switch, whereby shape bar 23 is lowered and braid strip P is pressed into recess 72 of baseplate 51. Thereby, the two borders of braid strip P are brought into an upright position, as shown in FIG. 6. Then, at an instant controlled by limit switches, compressed air is supplied through connection 74 to air cylinder 75. Thereby, slide blocks 59, 60 and folding slides 63, 65 which are mounted thereon through lugs 61, 62, are displaced toward vertical web 24 of shape bar 23. By this motion, as shown in FIG. 7, the upright borders of braid strip P are folded about shape bar 23 to the shape of an inverted T. Due to the hinged connection of folding slides 63, 65 with with lugs 61, 62 and the provision of springs 67, 68, folding slides 63, 65 adapt automatically to variations in the thickness of the material.

Figure 8:
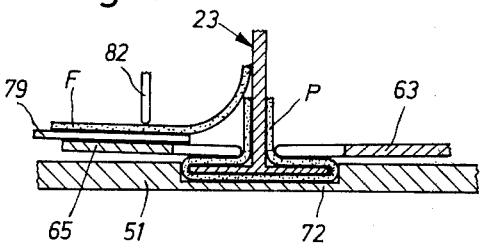
Figure 9:
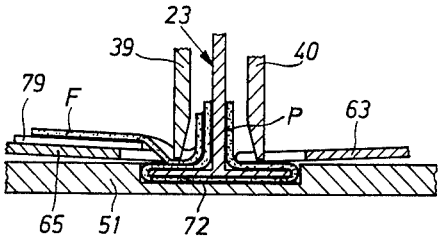

In the folding end position of folding slide 65, flap feed sheet 79, with flap F thereon, comes into a position below dog sheet 82. Then, air cylinder 86 is supplied with compressed air through connection 87. In consequence, dog sheet 82 is moved downwardly, applies against flap F which is placed on flap feed sheet 79, deflects sheet 79 downwardly about the bending line thereof, and drives the flap toward shape bar 23 so that one border of the flap comes to apply against web 24, in a position shown in FIG. 8. In a following operation, clamping strips 39, 40 are moved downwardly, by supplying compressed air through connection 46 to air cylinder 45, and clamp flap F and braid strip P firmly to shape bar 23 (FIG. 9), with the teeth of clamping bars 39, 40 passing through the tooth spaces of folding slides 63, 65. By interrupting the compressed air supply to connections 87 of air cylinder 86 and 74 of air cylinder 75 and supplying compressed air through connection 88 of air cylinder 86 and connection 73 of air cylinder 75, dog sheet 82 and folding slides 63, 65 are returned to their respective initial positions. Flap feed sheet 79 is thereby relieved and, due to the elasticity of its material, also returns into its initial position, shown in FIG. 2.

Shape bar 23, with flap F and braid strip firmly clamped thereto, is then moved upwardly, by interrupting the compressed air supply to connection 35 and directing the air to connection 36 of air cylinder 34. The switch sequence started by the single starting pulse is thereby finished.

Now, by releasing another pilot pulse, the operator may start a new switching sequence in which air cylinder 14 is supplied with compressed air through connection 15, whereby, support 18, with shape bar 23 and the component parts of the work (flap F and braid strip P) firmly clamped thereto, is swung from its initial position above recess 72 of folding mechanism 50, shown in FIG. 2 in dash-dotted lines, into the transfer position in front of the stitch forming area, shown in FIG. 2 in solid lines. Then, controlled through a limit switch, compressed air is supplied through connection 35 to air cylinder 34 whereby shape bar 23 with flap F and braid strip P thereon is lowered onto cut W which is in an already aligned standby position. As shown in FIG. 1 by the dash-dotted and solid lines, indicating the positions of parting blade 28, during its downward motion, shape bar 23, due to its particular mounting on support 18, performs also a motion which is directed toward the stitch forming area so that, in the transfer position, parting blade 28 projects close to cutting knife 8.

Figure 10:
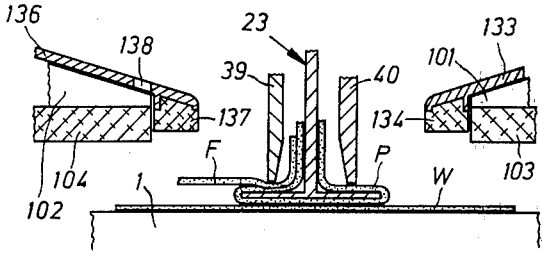
Figure 11:
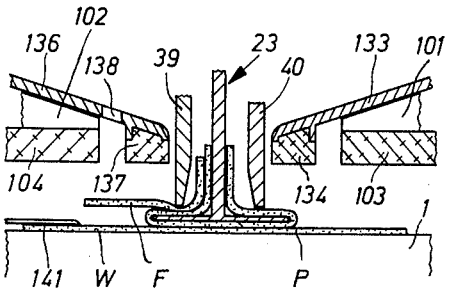
Figure 12:
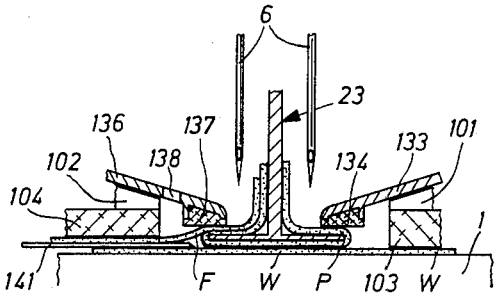

Subsequently, in response to the action of a limit switch, pressure fluid is supplied through connection 113 to advance unit 115 whereby work clamp 100, which is lifted from the work, is displaced in a direction opposite to the advance direction, i.e., against arrow V, into a position above the standing-by component parts (flap F, braid strip P and cut W), see FIGS. 1 and 10. Now, controlled by limit switches, compressed air is supplied through connections 128, 130, to air cylinders 124, 125 and through connection 117 to air cylinder 119. Thereby, clamping strips 133 and 136 are displaced toward shape bar 23 (FIG. 11) and clamping plates 101 and 102, with clamping strips 133, 136 extended, are lowered onto the work (FIGS. 1, 2 and 12). Finally, by supplying compressed air through connection 144 to air cylinder 146, reflecting sheet 141 is introduced between flap F and cut W (FIGS. 2 and 12) whereupon, the described cycle of operations may be started again.

While a specific embodiment of the invention has been shown and described in detail to illustrate the application of the principles of the invention, it will be understood that the invention may be embodied otherwise without departing from such principles.

What is claimed is:

1. In a device for manufacturing braided openings in cuts of articles of clothing, of the type comprising a folding mechanism, for a braid strip, mounted at a location spaced from the stitch forming area of a two-needle sewing machine installed in a table plate and having an arm shaft, a work clamp displaceable relative to the stitch forming area, and a cutting knife working between the needles, with folding of a braid strip being effected by a shape bar, having an inverted T-shape, adapted to be lowered into a folding groove, and by folding slides mounted for movement toward the shape bar to fold a braid strip about the shape bar, and further comprising a work clamp by which a cut of clothing and, if provided, a flap to be placed in contact with a folded braid strip, are received and fed to the stitch forming area: the improvement comprising, in combination, means mounting said folding mechanism, laterally of said stitch forming area and above the location where the cuts are fed to said stitch forming area, to extend in a plane inclined toward said table plate; a baseplate in said folding mechanism, formed with an elongated recess constituting said folding groove; a support; means mounting said shape bar for displacement vertically of said support; means mounting said support for pivoting, about an axis parallel to the axis of said arm shaft, between an initial position, in which said shape bar is aligned with said recess forming the folding groove, and a transfer position, in which said shape bar is aligned, in advance of said stitch forming area, with the direction of displacement of said work clamp, for effecting delivery of a braid strip and flap to said work clamp; and clamping bars, for a braid strip and a flap, mounted on said support on respective opposite sides of the web of said shape bar for displacement parallel to said web.

2. In a device for manufacturing braided openings, the improvement claimed in claim 1, including folding slides mounted on said baseplate for displacement toward said folding groove to engage the bent-up borders of a braid strip folded by entry of said shape bar into said folding groove, to fold the bent-up borders of the braid strip about said shape bar.

3. In a device for manufacturing braided openings, the improvement claimed in claim 2, in which said folding slides are pivoted to said baseplate at their edges opposite their mutually facing folding edges; and means biasing said folding slides toward engagement with said baseplate.

4. In a device for manufacturing braided openings, the improvement claimed in claim 1, including a flap feed sheet mounted on one of said folding slides for movement of a flap into engagement with a braid strip folded about said shape bar; and means on said support operable to engage a flap being moved toward said shape bar on said flap feed sheet, to maintain said flap on said flap feed sheet.

5. In a device for manufacturing braided openings, the improvement claimed in claim 4, in which said flap feed sheet is a bent one-piece sheet secured adjacent one end to said one folding slide, said flap feed sheet being flexible, in the manner of a hinge, about the bend therein; said means on said support engageable with a flap on said flap feed sheet comprising a dog sheet mounted for vertical displacement on said support.

6. In a device for manufacturing braided openings, the improvement claimed in claim 1, in which the vertical web of said shape bar is formed with an extension which, in said transfer position of said shape bar, extends to a position immediately adjacent said cutting knife; said extension being in the form of a parting blade for the bent-up borders of the braid strip.

7. In a device for manufacturing braided openings, the improvement claimed in claim 6, in which said means mounting said shape bar for displacement vertically of said support includes guide means guiding said shape bar, during downward movement thereof toward said work clamp, in a direction toward the working zone of said needles.

8. In a device for manufacturing braided openings, the improvement claimed in claim 7, in which said means mounting said shape bar for displacement vertically of said support further includes means maintaining said shape bar against rotation relative to said support.

9. In a device for manufacturing braided openings, the improvement claimed in claim 8, in which said last-named means comprises downwardly opening slots formed in a pair of downwardly extending legs of said support; and rollers on said shape bar engaged in said slots.

10. In a device for manufacturing braided openings, the improvement claimed in claim 1, including support means secured to and extending from said work clamp; and a reflecting sheet mounted on said support means and movable into engagement between a flap, folded around said shape bar, and a cut of clothing; said reflecting sheet being cooperable with a reflection light barrier mounted on said sewing machine.

* * * * *